US006695632B2

(12) United States Patent
Matsumoto et al.

(10) Patent No.: US 6,695,632 B2
(45) Date of Patent: Feb. 24, 2004

(54) SHIELD CONNECTOR

(75) Inventors: Mitsuhiro Matsumoto, Shizuoka (JP); Hirotaka Fukushima, Shizuoka (JP); Hajime Kato, Shizuoka (JP)

(73) Assignee: Yazaki Corporation, Toyko (JP)

( * ) Notice: Subject to any disclaimer, the term of this patent is extended or adjusted under 35 U.S.C. 154(b) by 0 days.

(21) Appl. No.: 10/425,972

(22) Filed: Apr. 30, 2003

(65) Prior Publication Data

US 2003/0207607 A1 Nov. 6, 2003

(30) Foreign Application Priority Data

May 1, 2002 (JP) ..... 2002-129601

(51) Int. Cl.[7] ..... H01R 13/64
(52) U.S. Cl. ..... 439/246
(58) Field of Search ..... 439/352, 357, 439/685, 924.1, 34, 246, 247

(56) References Cited

U.S. PATENT DOCUMENTS 6,457,980 B2 * 10/2002 Hattori et al. ..... 439/246
6,497,579 B1 * 12/2002 Garbini ..... 439/246

FOREIGN PATENT DOCUMENTS

| | | | |
|---|---|---|---|
| EP | 0 314 229 A1 * | 5/1989 | ..... 439/246 |
| EP | 0 549 386 A1 * | 6/1993 | ..... 439/246 |
| JP | 2000-277217 | 10/2000 | |

* cited by examiner

*Primary Examiner*—Tho D. Ta
(74) *Attorney, Agent, or Firm*—Armstrong, Kratz, Quintos, Hanson & Brooks, LLP

(57) ABSTRACT

A low-cost shield connector 1 connecting smoothly with a mating connector includes a connector housing 20, a terminal 21, an inner housing 22, a spacer 23 and a lance 42. The connector housing 20 is formed into tubular shape. The terminal 21 is joined to a shield wire 29. The inner housing 22 receiving the terminal 21 is received in the connector housing 20. The spacer 23 to be mounted in the inner housing 22 prevents the terminal 21 from coming off from the inner housing 22. The lance 42 formed integrally with the inner housing 22 is locked in the connector housing 20.

2 Claims, 11 Drawing Sheets

SHIELD CONNECTOR

BACKGROUND OF THE INVENTION

1. Field of the Invention

This invention relates to a shield connector to be used for joining electric wires.

2. Description of the Related Art

In an automobile as a vehicle, various electronic devices are installed. Therefore, a wire harness is provided in the automobile for supplying signals and electric power to the electronic devices. The wire harness has a plurality of electric wires and connectors joined to the electric wires.

In an electric car, a hybrid car or a fuel-cell powered car, a three-phase alternating-current motor may be used for a drive motor as the electronic device. Such drive motor is supplied with high-voltage electric power. Therefore, a connector for supplying the motor with electric power is required to prevent from leakage noise from terminals to an outside thereof.

The connector mentioned above includes three terminals and a connector housing to receive the three terminals. In the connector for the motor, high-voltage electric power is transmitted so that the terminals are fixed rigidly in the connector housing so as to allow no relative movement between the terminals and the connector housing. Therefore, when the connector is connected to the mating connector, friction force between the terminals of the connector and corresponding terminals of the mating connector may be increased by displacements between the terminals so that the connector may have difficulty to be connected to the mating connector.

To overcome the above drawback, a floating connector shown in J.P. Application Laid-open 2000-277217 is proposed. The floating connector includes a terminal, a connector housing for receiving the terminal, a tubular shell for receiving the connector housing and a spring washer as an elastic member. The connector housing is supported with the spring washer in the tubular shell. The spring washer is elastically deformed so that the connector housing can move freely in the tubular shell.

Objects to be Solved

When the connector described in aforesaid document is engaged with a mating connector, the length of elastic deformation of the spring washer is changed so as to connect the terminal of the connector to the corresponding terminal of the mating connector. Thereby, friction force between terminals is reduced and the connector can be engaged easily with the mating connector. However, the connector described in aforesaid document is provided with a spring washer to allow the connector housing moving freely so that number of parts in the connector may be increased. Therefore, number of man-hour for assembling may be increased and cost of the connector may be increased.

To overcome the above drawback of prior art, one object of this invention is to provide a low-cost shield connector which can be engaged easily with a mating connector.

SUMMARY OF THE INVENTION

How to Attain the Object

In order to attain the objects, a shield connector, according to the present invention, connecting to a mating connector, having a terminal joined with an electric wire, an inner housing made of an insulating synthetic resin for receiving said terminal and a connector housing made of a metal for receiving said inner housing, the inner housing electrically insulating said terminal from said connector housing, includes a hole passing through the inner housing, a spacer inserted into said hole and mounted in said inner housing to prevent said terminal from coming off from the inner housing, and a locking portion formed integrally with the inner housing to be elastically deformed freely, so as to be elastically deformed temporarily when the inner housing is inserted into the connector housing and be returned by elastic restoring force after the inner housing is received in the connector housing for locking with the connector housing.

According to the shield connector mentioned above, the terminal is mounted in the inner housing by the spacer. By engaging the locking portion formed integrally with the inner housing with the connector housing, the inner housing is mounted in the connector housing. The locking portion can be elastically deformed freely.

By existing a clearance between the terminal and the inner housing and by changing the length of elastic deformation of the locking portion, the terminal and the inner housing can move against the connector housing so as to connect the terminal with the corresponding terminal of mating connector.

The locking portion is formed integrally with the inner housing made of synthetic resin. Therefore, increasing number of parts can be prevented.

The shield connector according to the present invention includes a plurality of the terminals and a plurality of the inner housings protecting from the connector housing and penetrating into the mating connector when the connector connects with the mating connector, and a length of projection of one of the plurality of inner housings is longer than that of the others.

According to the shield connector mentioned above, the one inner housing projects from the connector housing more than the other inner housings. Thereby, when the connector is engaged with the mating connector, the one inner housing firstly goes into the mating connector so as to connect the terminal inserted in the one inner housing to the corresponding terminal of the mating connector.

Therefore, the one inner housing projecting most from the connector hosing is firstly positioned against the connector housing. When the connector goes more into the mating connector, the other inner housings are inserted into the mating connector and the other inner housings are positioned against the connector housing. Thus, after the one inner housing is positioned against the connector, the other inner housings are positioned against the connector.

The above and other objects and features of this invention will become more apparent from the following description taken in conjunction with the accompanying drawings.

DESCRIPTION OF THE PREFERRED EMBODIMENT

Figure 1:
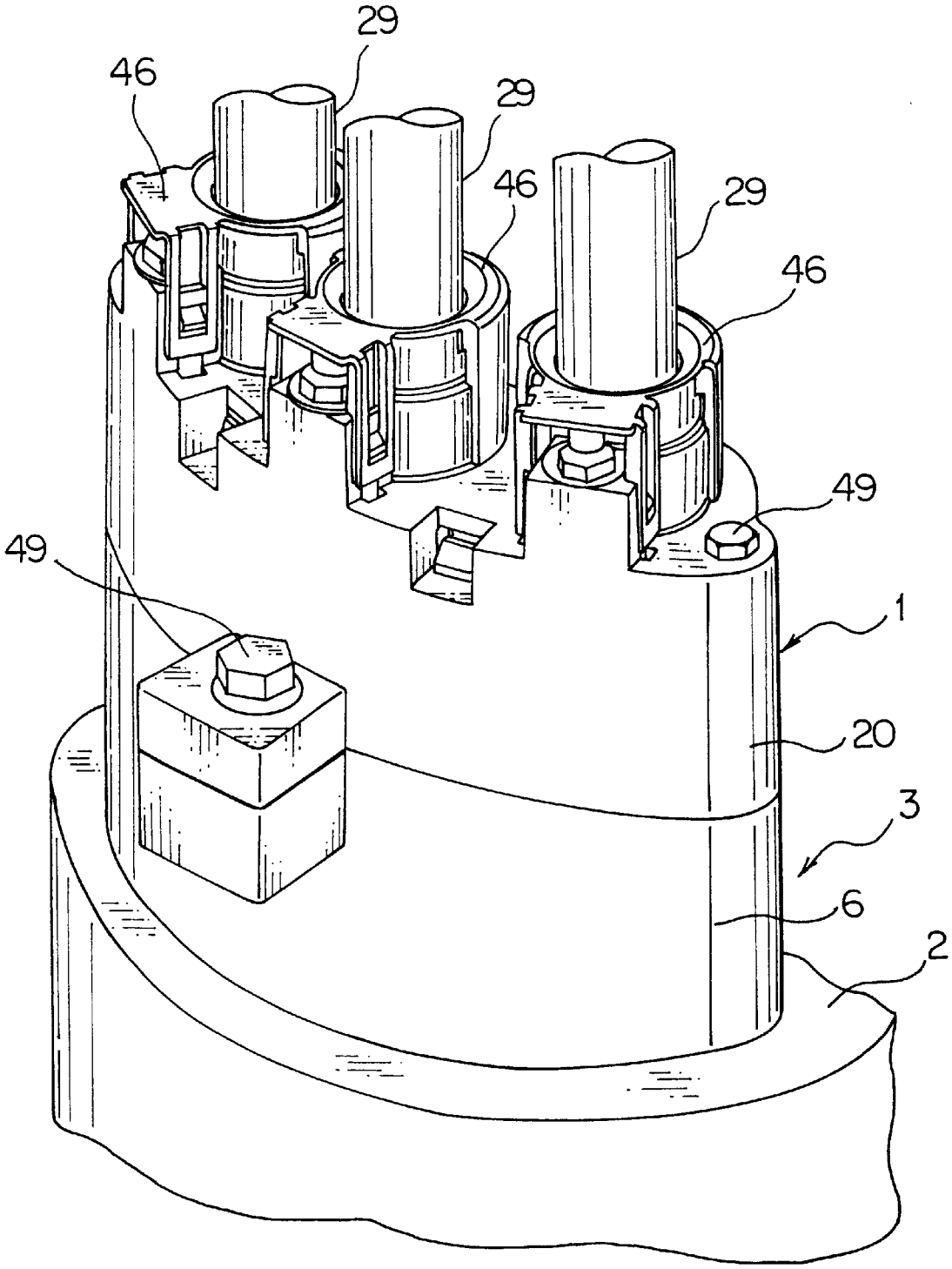
FIG. 1 is a perspective view of one embodiment of a shield connector according to this invention connecting with a mating connector.
Figure 2:
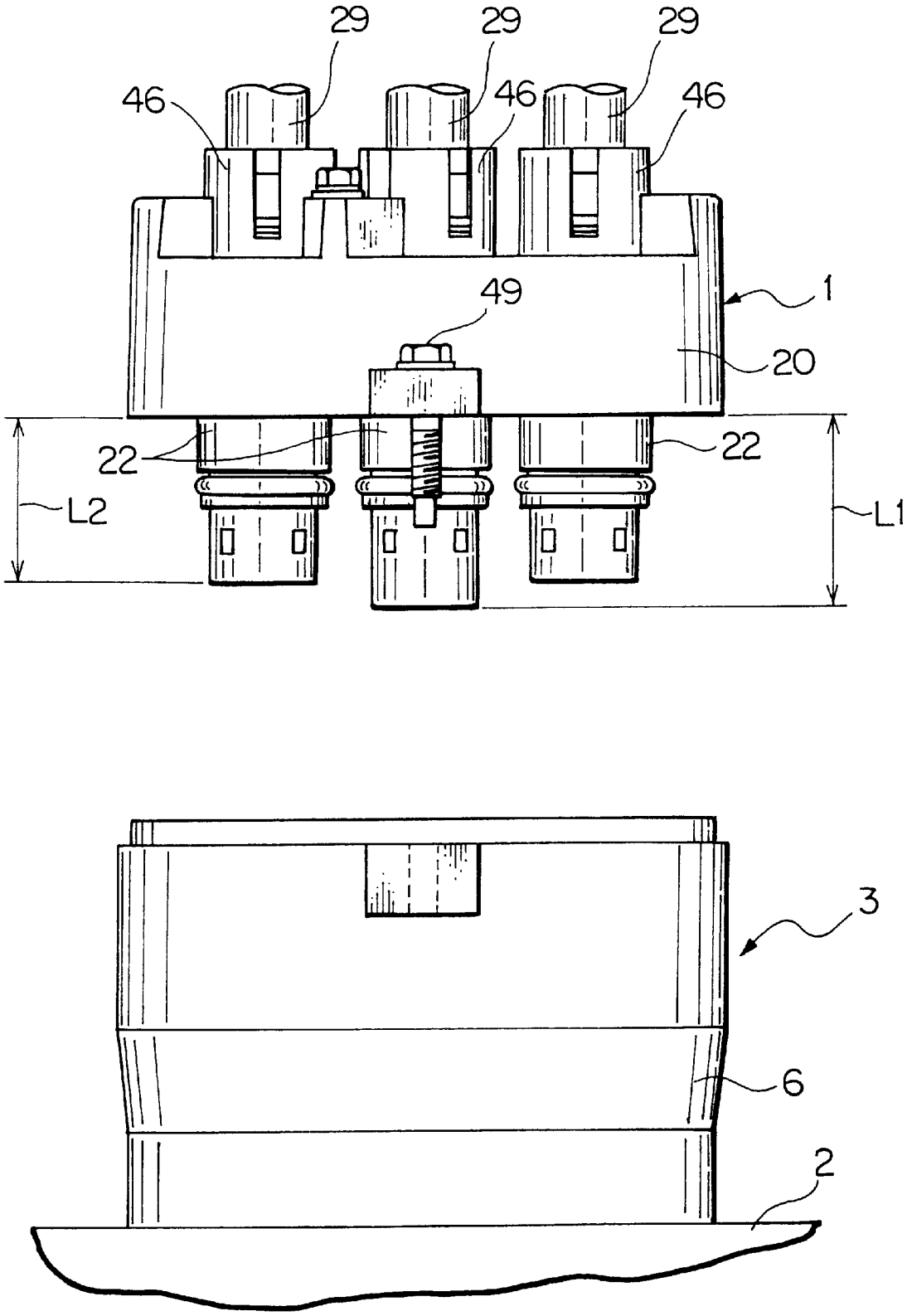
FIG. 2 is a side view, showing the separated shield connector from the mating connector shown in FIG. 1.

A shield connector of an embodiment according to the present invention will now be described with reference to from FIG. 1 to FIG. 12. The shield connector 1 shown in FIGS. 1 and 2 is engaged with a mating connector 3 joined to a motor 2 of, for example, an electric car, a hybrid car or fuel-cell powered car, for supplying electric power to the motor 2. The motor 2 is used for drive source to drive the above-mentioned automobile. The motor 2 is a three-phase alternating-current (AC) motor.

Figure 6:
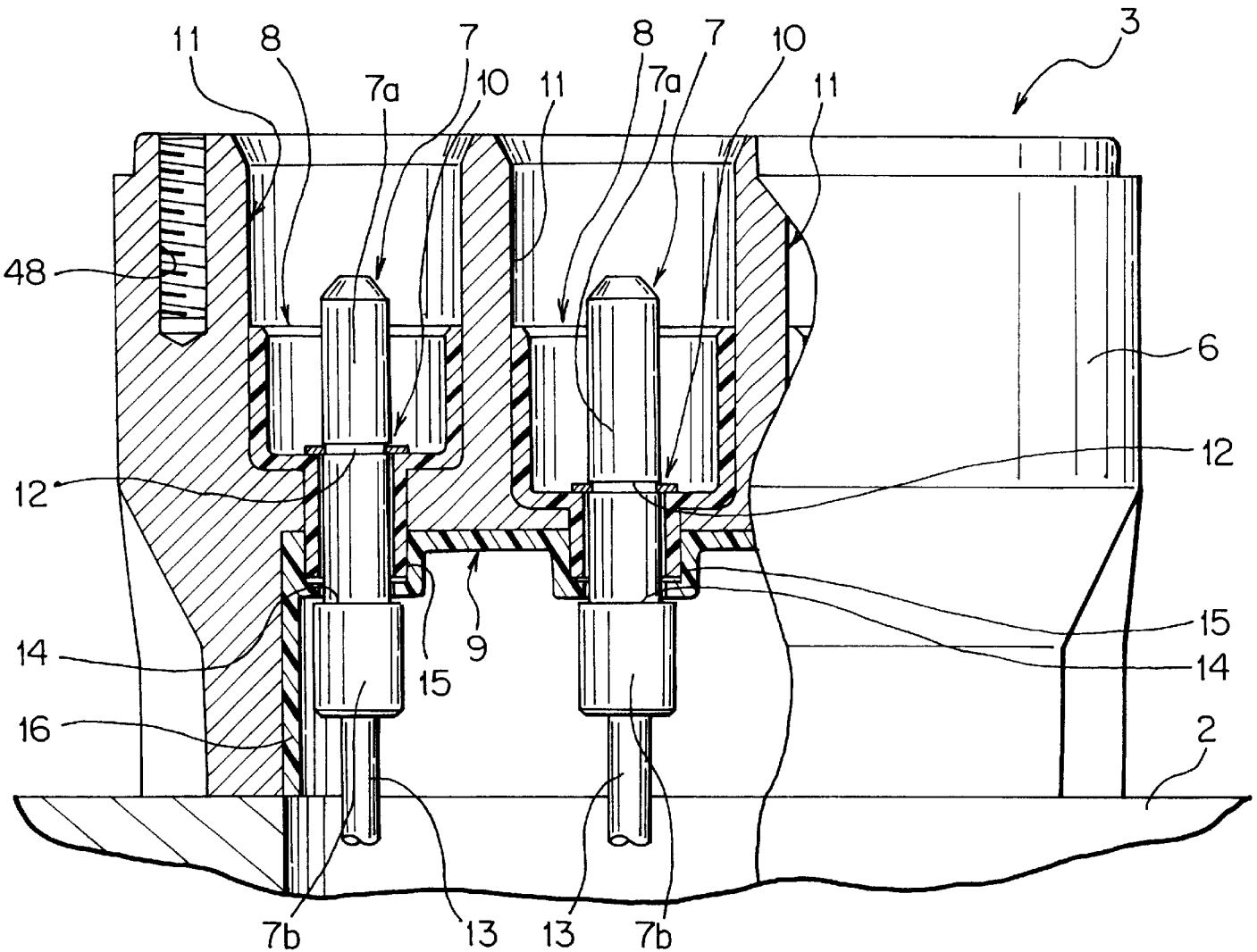
FIG. 6 is a partial sectional view of the mating connector shown in FIG. 2.

The mating connector 3, as shown in FIG. 6, includes a connector housing 6, a plurality of rod-shaped terminals 7, a first insulating member 8, a second insulating member 9 separated from the first insulating member 8 and a C-ring 10. The connector housing 6 is formed into tubular shape with an electrical conductive metal. The connector housing 6 is mounted on the motor 2. The connector housing 6 has a plurality of terminal receiving sections 11. In an example shown in FIG. 6, the connector housing 6 has three terminal receiving sections 11. The terminal receiving sections 11 are disposed in parallel to each other. The terminal receiving section 11 has a round cross-section.

The terminal 7 is received in the terminal receiving section 11. The terminal 7 is formed into rod shape with an electrical conductive metal. In the example shown in FIG. 6, three terminals 7 are provided. The terminal 7 is formed at one end portion 7*a* thereof with a concave groove 12. The concave groove 12 is formed round on the terminal 7. The concave groove 12 is dented from an outer surface of the terminal 7. C-ring 10 is locked in the concave groove 12.

An electric wire 13 is joined to the other end portion 7*b* of the terminal 7. The electric wire 13 is a covered electric wire having an electric conductive core wire and an insulating cover portion. The electric wire is joined to the motor 2. The terminal 7 is provided at the other end portion 7*b* with a step portion 14. The step 14 increases outer diameter of the terminal 7 stepwise from the one end portion 7*a* toward the other end portion 7*b*.

Three first insulating members 8 are provided respectively for each terminal 7. The first insulating member 8 is formed into tubular shape with an insulating synthetic resin. The second insulating member 9 is made of an insulating synthetic resin. The second insulating member 9 is provided integrally with three tubular portions 15 and one cylinder portion 16. Inner diameter of the tubular portion 15 is larger than outer diameter of the first insulating member 8. The cylinder portion 16 is formed into cylindrical shape and provided inside thereof with the three tubular portions 15.

The first insulating member 8 and the second insulating member 9 are mounted in the connector housing 6 so as to insert the end portion of the first insulating portion 8 into the tubular portion 15 of the second insulating member 9. The first and second insulating members 8 and 9 insulate electrically the terminals 7 from the connector housing 6. The C-ring 10 is locked in the concave groove 12 of the terminal 7. Thereby, the first and second insulating members 8 and 9 are held between the C-ring 10 and the step portion 14 to prevent the first and second insulating members 8 and 9 and terminals 7 from coming off from the connector housing 6.

In the mating connector 3 mentioned above, the terminals 7 are received in the terminal receiving section 11, and the first and second insulating members 8 and 9 insulate electrically the terminals 7 from the connector housing 6. The C-ring 10 and the step portion 14 prevent the first and second insulating members 8 and 9 from coming off from the connector housing 6. The connector housing 6 is mounted on the motor 2. The electric wire 13 is joined to the terminal 7.

The connector housing 6 is made of metal so that the mating connector 3 prevents noise generated mainly by electric current flowing in the terminals 7 from leaking to outside. The mating connector 6 also prevents noise from coming into the terminals 7 from outside.

Figure 3:
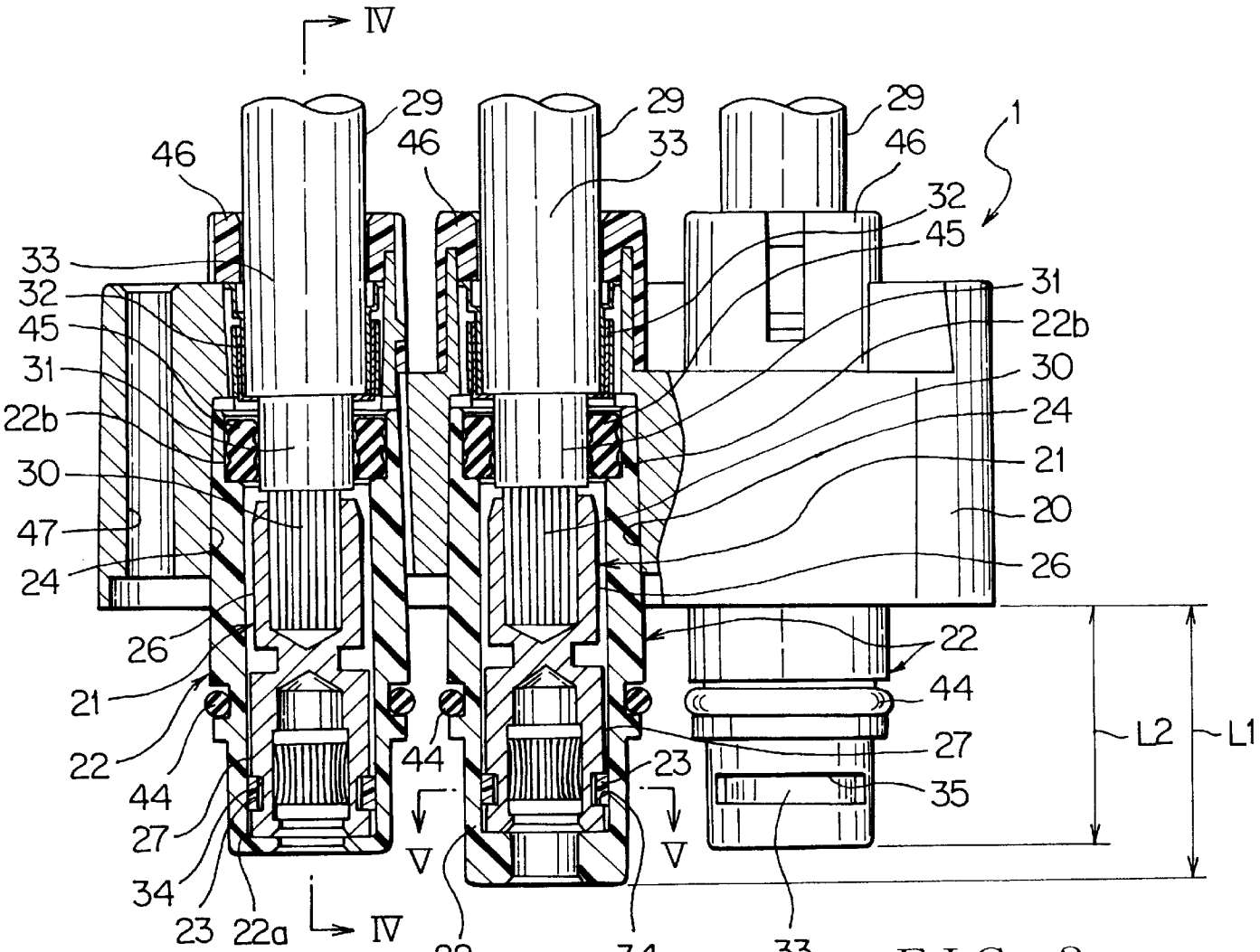
FIG. 3 is a partial sectional view of the shield connector shown in FIG. 2.
Figure 4:
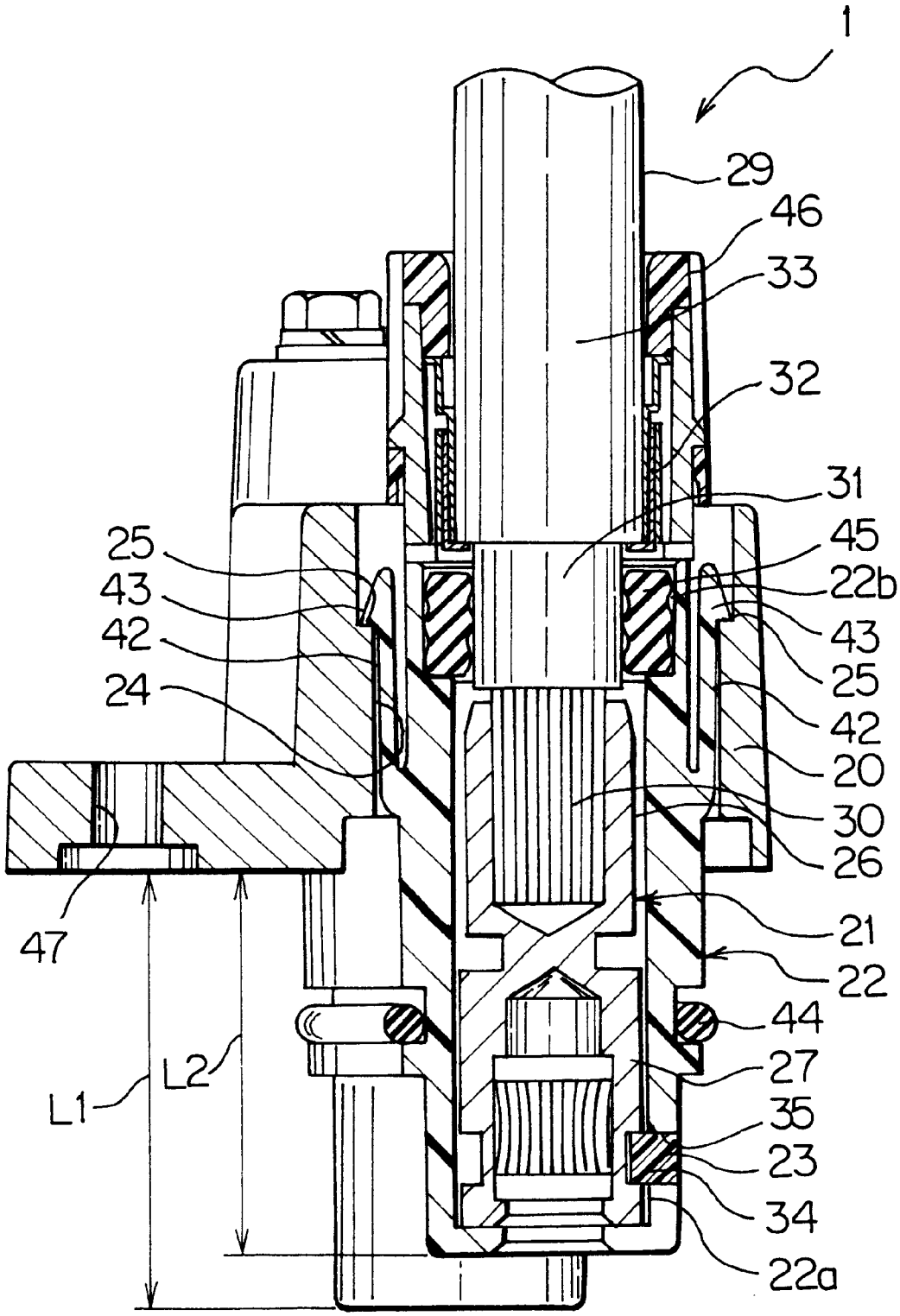
FIG. 4 is a sectional view taking along the line IV—IV in FIG. 3.

A shield connector 1, as shown in FIGS. 3 and 4, includes a connector housing 20, terminals 21, inner housings 22 and spacers 23. The connector housing 20 is formed into tubular shape with an electrical conductive metal. The connector housing 20 has a plurality of terminal receiving sections 24. In an example of the drawings, three terminal receiving sections 24 are provided. The terminal receiving section 24 extends linearly. The terminal receiving sections 24 are disposed in parallel to each other. The terminal receiving section 24 has a round shape cross section perpendicular to lengthwise thereof. Each terminal receiving section 24 is provided inside thereof with a step 25 (shown in FIG. 4). The step 25 increases inner diameter of the terminal receiving section 24 stepwise from one end portion 22*a* of the inner housing 22 toward the other end portion 22*b* of the inner housing 22.

The terminal 21 is received in the inner housing 22. The terminal 21 is made of an electrical conductive metal and provided integrally with an electric-wire connect portion 26 and an electric contact portion 27. The electric-wire connect portion 26 and the electric contact portion 27 are formed into tubular shape to be joined coaxially and serially. A core wire 30 of a shield wire 29 is inserted into inside of the electric-wire connect portion 26 to connect with the shield wire 29.

The shield wire 29 is formed with an electrical conductive core wire 30, an insulating first covering portion 31 covering the core wire 30, an electrical conductive braid 32 covering the first covering portion 31 and an insulating second covering portion 33 covering the braid 32. The core wire 30 of the shield wire 29 is electrically connected to an AC/DC converter as an electronic device. The core wire 30 is inserted into the electrical connect portion 26 to connect electrically to the terminal 21. The braid 32 is electrically connected to the connector housing 20. The shield wire 29 corresponds to the electric wire described in this specification.

The one end portion 7*a* of the terminal 7 in the mating connector 3 is inserted into the electric contact portion 27 to connect electrically with the terminal 7. The electric contact portion 27 is formed with a groove 34 dented from an outer surface of the terminal 7. The groove is formed around the terminal 7. When the terminal 7 is received in the inner housing 22, the groove 34 communicates to a later-described hole 35. In other words, the groove 34 opens through the hole 35 toward outside of the inner housing 22.

The inner housing 22 is formed into tubular shape with insulating synthetic resin. A plurality of inner housings 22 is provided. In the example of the drawing, three inner housings 22 are provided. Each inner housing 22 receives one terminal 21 and an end portion of the shield wire 29 connected with the one terminal 21. The inner housing 22 is received in the terminal receiving section 24 of the connector housing 20. The hole 35 shown in FIGS. 4 and 5 passes through the one end portion 22*a* of the inner housing 22.

Figure 5:
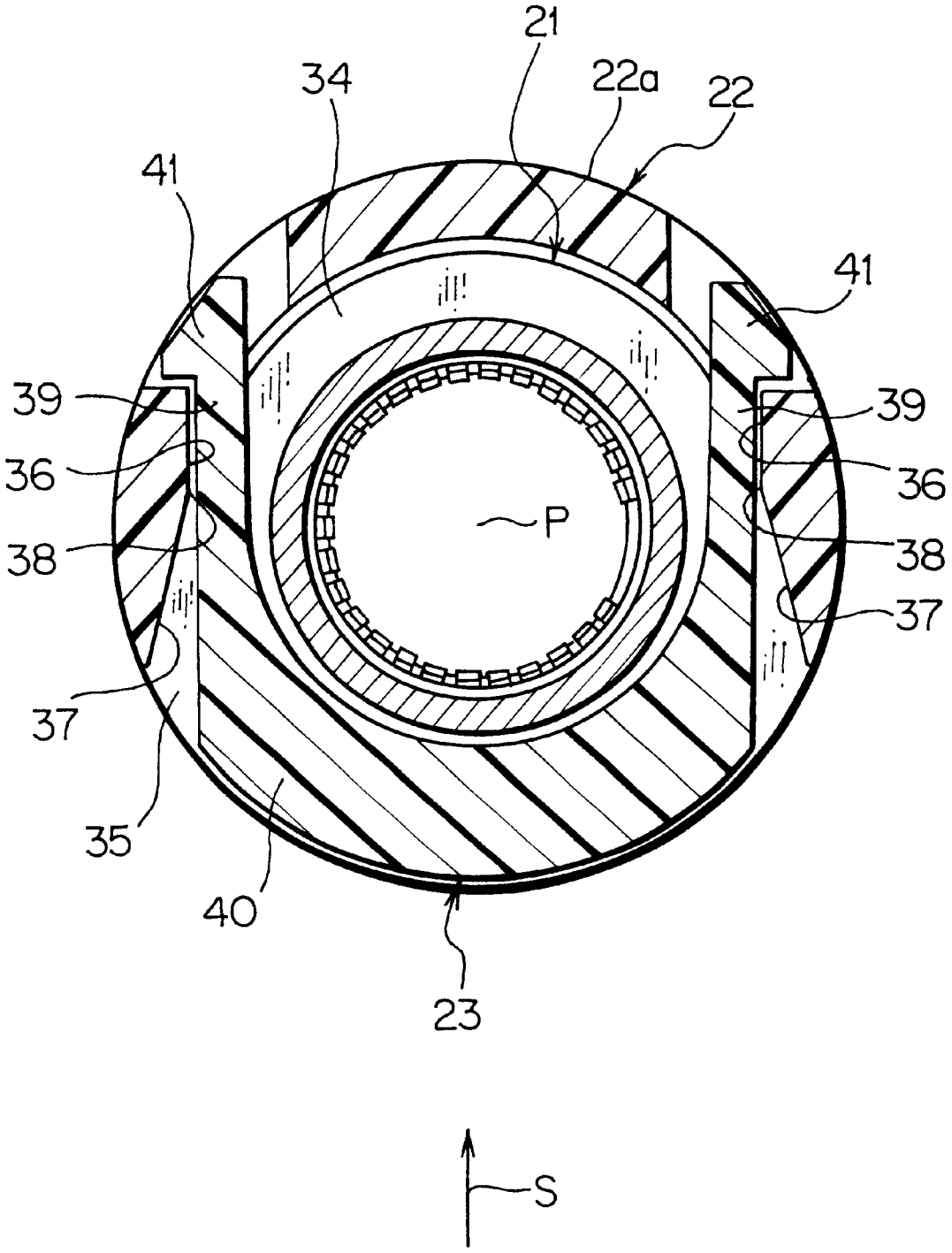
FIG. 5 is a sectional view taking along the line V—V in FIG. 3.

The hole 35 communicates from inside of the inner housing 22 to outside of the inner housing 22. The hole 35, as shown in FIG. 5 is provided at inside thereof with a pair of parallel surfaces 36 and a pair of tapered surfaces 37. The parallel surfaces 36 are level along an arrow S of a direction of inserting the spacer 23 into the hole 35.

The tapered surface 37 is continuous to the parallel surface 36 and extends from the parallel surface 36 toward an opening of the hole 35. The pair of tapered surfaces 37 is inclined against the arrow S so as to increase gradually a space to each other from the parallel surfaces 36 toward the opening of the hole 35. A boundary 38 between the parallel surface 36 and the tapered surface 37 is located at a deeper position of the hole 35 than a center P of a cross section perpendicular to lengthwise of the inner housing 22. In other words, the boundary 38 is located nearer to the opening along the arrow S than the center P.

The spacer 23 made of synthetic resin is provided integrally with a pair of lock arms 39 parallel to each other and a connect portion 40 connecting to respective one end portions of the lock arms 39. The pair of lock arms 39 is flexible so as to be elastically deformed freely in a direction to decrease a space therebetween. The other end portions of the lock arms 39 have respectively lock projections 41. The lock projections 41 project from the other end portions in a direction of aparting the pair of lock arms 39 to each other. The lock projections 41 are locked at end edges, far from the opening of the hole 35, of the parallel surfaces 36. Thus, the lock projections 41 are locked in the inner housing 22.

The spacer 23 is inserted into the hole 35 along the arrow S of the direction of extending the pair of lock arms 39. The lock projections 41 abut on the tapered surfaces 37 and the pair of lock arms 39 is elastically deformed temporarily in a direction of moving close to each other. Thereafter, the lock protections 41 move over the boundaries 38, and abut on the parallel surfaces 36. Thereafter, the lock projections 41 are positioned at end edges, far from the opening of the hole 35, of the parallel surfaces 36.

The pair of lock arms 39 is moved in a direction of increasing a space between the lock projections 41 by elastic restoring force of the lock arms 39. Thus, the lock projections 41 are locked at end edges, far from the opening of the hole 35, of the parallel surfaces 36. In other words, the lock projections 41 are locked in the inner housing 22. When the terminal 21 is received in the inner housing 22, the lock arms 39 of the spacer 23 go into the groove 34. Therefore, the spacer 23 prevents the terminal 21 from coming off from the inner housing 22.

The shield connector 1 has a lance 42 as a locking portion in this specification. The lance 41 1s formed integrally with the inner housing 22 of synthetic resin, as shown in FIG. 4. A pair of lances 41 is provided on each inner housing 22. Lengthwise of the lance 41 is parallel to the lengthwise of the inner housing 22. Thereby, the pair of lances 41 is parallel to each other. One end of the lance 41 is continuous to a center portion of lengthwise of the inner housing 22. The other end of the lance 41 extends from the one end thereof toward the other end portion 22*b* of the inner housing 22. A lock projection 43 is provided at the other end of the lance 41.

The lock projections 43 project from the other ends of the lances 42 in a direction of aparting the pair of lances 42 to each other, i.e. outwardly from the inner housing 22. The lock projections 43 are locked at the step 25 of the connector housing 20. In other words, the lock projections 43 are locked in the connector housing 20 so as to mount the inner housing 22 in the connector housing 20. The pair of lances 42 is flexible so as to be elastically deformed freely in a direction to be close to each other.

For mounting the inner housing 22 in the connector housing 20, the other end portion 22*b* of the inner housing 22 is inserted into the terminal receiving section 24. Thereby, the lock projections 43 abut on an inner surface of the terminal receiving section 24 and the lances 41 are elastically deformed temporarily in a direction of moving the lock projections 43 close to each other, i.e. toward inside of the inner housing 22.

When the inner housing 22 is inserted more into the connector housing 20 and the inner housing 22 is received completely in the connector housing 20, the lock projections 43 are located at the step 25. The lock projections 43 are moved in a direction of aparting to each other by elastic restoring force of the lances 42. Thereby, the lock protections 43, i.e. the lances 42, are locked at the step 25, i.e. the connector housing 20.

The shield connector 1 further includes a packing 44 for maintaining water-tightness between the connector housing 6 of the mating connector 3 and the inner housing 22, a packing 45 for maintaining water-tightness between the shield wire 29 and the inner housing 22 and a rear holder 46. The packing 44 is provided on each inner housing 22. The packing 44 made of an elastic material, such as a rubber, is mounted on the outer surface of the one end portion 22*a* of the inner housing 22. The packing 44 maintains water-tightness between the outer surface of the inner housing 22 and the inner surface of the terminal receiving section 11 of the mating connector 3.

The packing 45 made of an elastic material, such as a rubber, is mounted on the inner surface of the other end portion 22*b* of the inner housing 22. The packing 45 maintains water-tightness between the inner surface of the inner housing 22 and the outer surface of the first covering portion 31 of the shield wire 29. The rear holder 46 engages with the connector housing 20 and the other end portion 22*b* of the inner housing 22.

In the shield connector 1, one inner housing 22, located in the center in FIG. 3, of three inner housings 22 projects more than the other two inner housings 22 from the connector housing 20. In detail, the length of projection L1 of the above-mentioned one inner housing 22 from the connector housing 20 is larger than the length of projection L2 of the other two inner housings 22 from the connector housing 20. The one inner housing 22 projects more toward the mating connector 3 from the connector housing 20 than the other two inner housings 22.

The shield connector 1 has a plurality of through holes 47 and the mating connector 3 has a plurality of threaded holes 48 for engaging to each other. Bolts 49 through the through holes 47 are screwed in the threaded holes 48 to engage the shield connector 1 with the mating connector 3.

For assembling the shield connector 1 mentioned above, the shield wire 29 is firstly joined to the terminal 21. The packing 45 is mounted on an end portion of the shield wire 29. The terminal 21 joined with the shield wire 29 is inserted into the inner housing 22 so as to expose the groove 34 through the hole 35 to outside of the inner housing 22. The packing 45 maintain water-tightness between the inner surface of the inner housing 22 and the outer surface of the first covering portion 31 of the shield wire 29.

The spacer 23 is inserted through the hole 35 into the inner housing 22. The lock projections 41 of the spacer 23 are engaged with the inner housing 22 so that the spacer 23 is mounted in the inner housing 22. When the spacer 23 is mounted in the inner housing 22, the terminal 21 does not come off from the inner housing 22. Clearance between the inner housing 22 and the terminal 21 exists so that the terminal 21 can move freely against the inner housing 22.

Thereafter, the packing 44 is mounted on the outer surface of the one end portion 22*a* of the inner housing 22. The inner housing 22 to be lead by the other end portion 22*b*, i.e. side of the shield wire 29, is inserted into the terminal receiving section 24 of the connector housing 20. The lock projections 43 of the lances 42 are engaged with the step 25 so that the lances 42 are locked in the connector housing 20. Thereby, the inner housing 22 is mounted in the connector housing 20. Thus, the shield connector 1 mentioned above is assembled. The lances 42 can be elastically deformed, so that the inner housing 22 can move freely against the connector housing 20.

Figure 7:
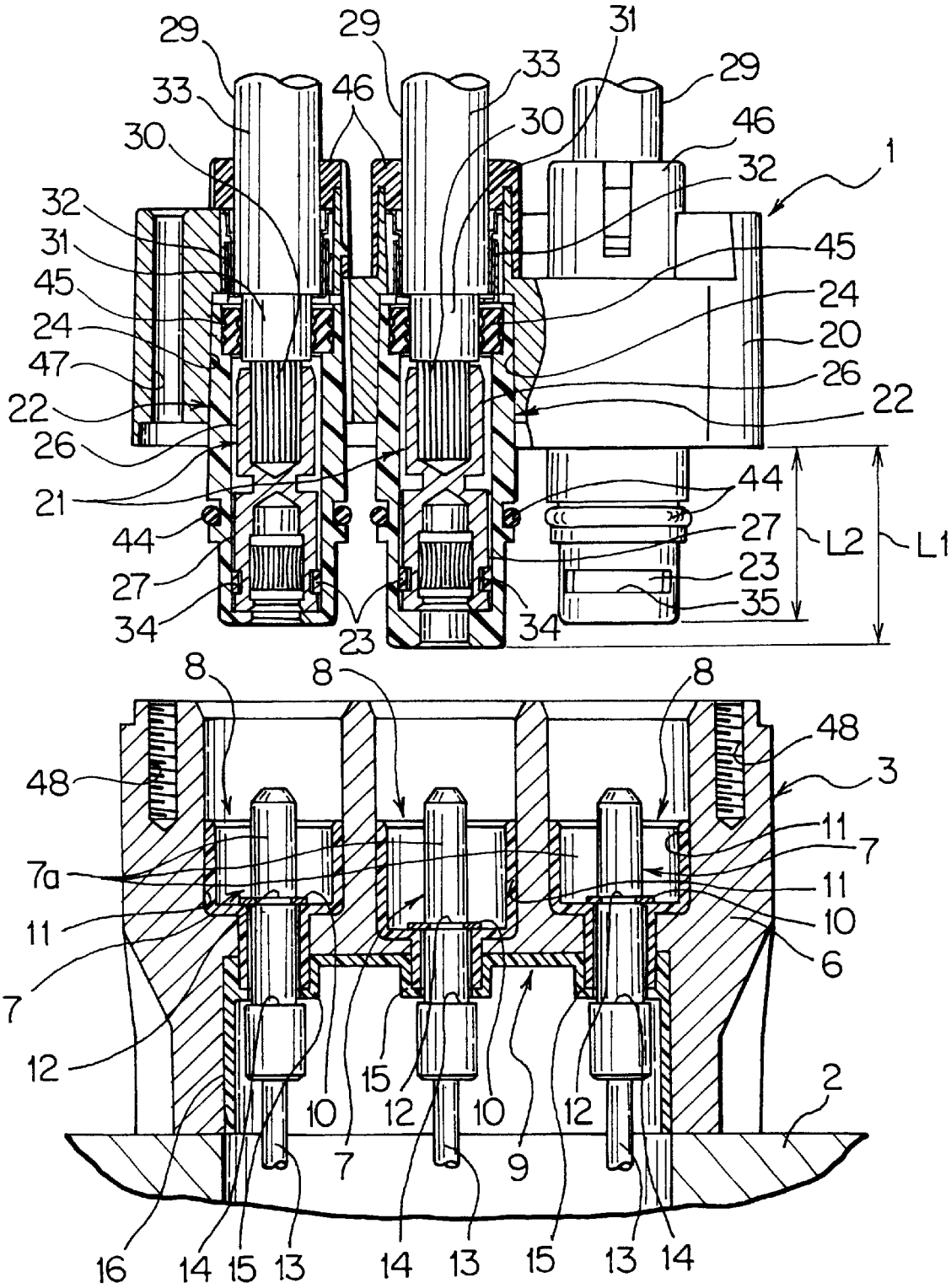
FIG. 7 is a partial sectional view of the connectors shown in FIG. 2.
Figure 8:
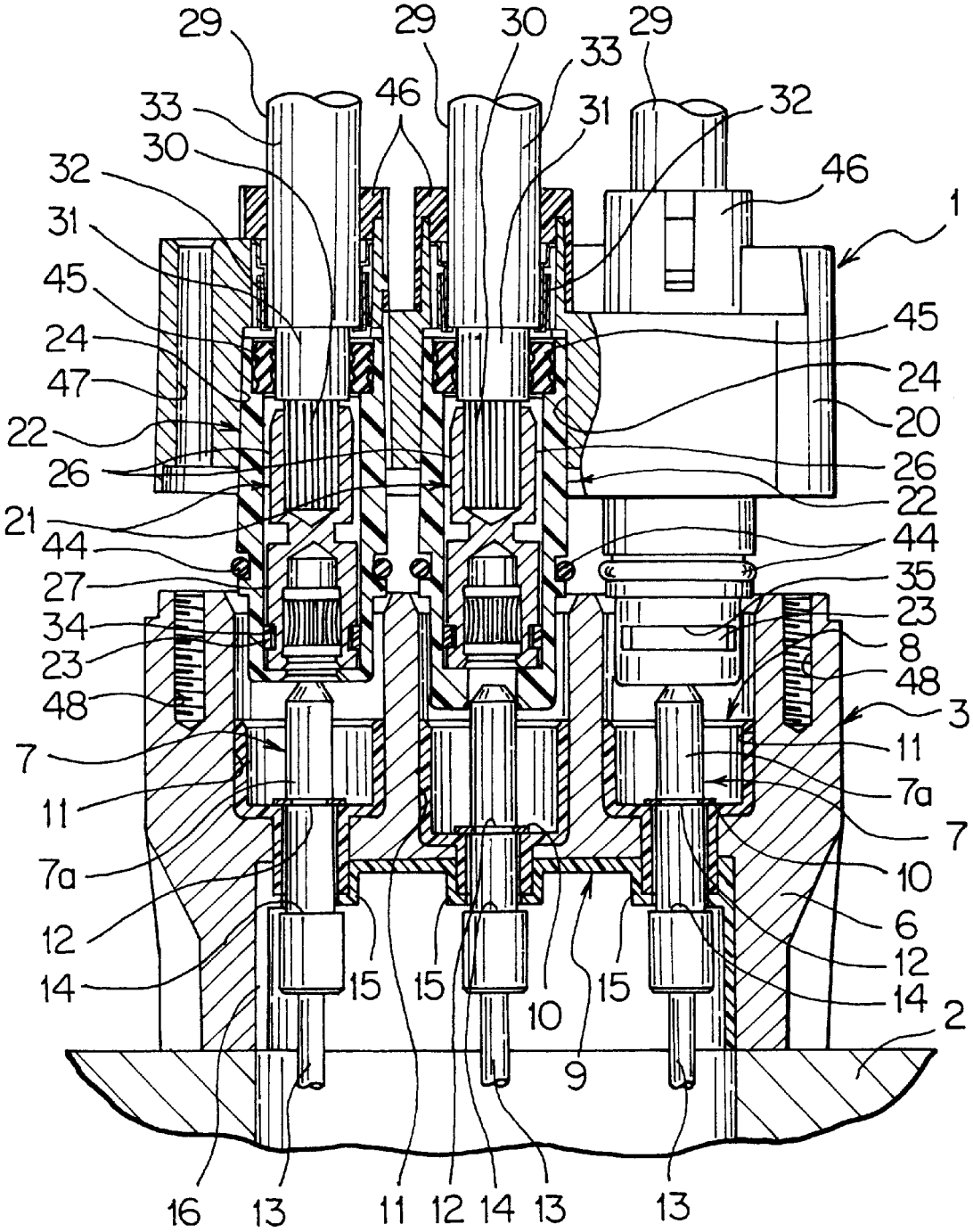
FIG. 8 is a partial sectional view of the connectors moved closer to each other than those shown in FIG. 7.

For connecting the shield connector 1 assembled as mentioned above and the mating connector 3, the electric contact portion 27 of the terminal 21 is firstly positioned to face the one end portion 7*a* of the terminal 7 of the mating connector 3, as shown in FIG. 7. When the shield connector 1 is moved close to the mating connector 3, the one inner housing 22 located in the center of the three inner housings 22 firstly goes into the mating connector 3. Thereby, the one end portion 7*a* of the terminal 7 of the mating connector 3 goes into inside of the one inner housing 22, as shown in FIG. 8. The one inner housing 22 is fittingly moved by the terminal 7 of the mating connector 3 and a value of elastic deformation of the lance 42 is changed. Thus, the one inner housing 22 is positioned against the connector housing 20.

When the shield connector is further moved closer to the mating connector 3, the one end portion 7*a* of the terminal 7 of the mating connector 3 goes into the electric contact portion 27 of the terminal 21 in the above-mentioned one inner housing 22, and the one end portions 7*a* of the terminals 7 go into the other two inner housings 22. Thus, the terminal 21 is fittingly moved by the terminal 7 and the terminal 21 is positioned against the one inner housing 22. The other two inner housings 22 are fittingly moved by the terminal 7 of the mating connector 3 and values of elastic deformation of the lances 42 are changed. Thus, the other two inner housings 22 are positioned against the connector housing 20.

Figure 9:
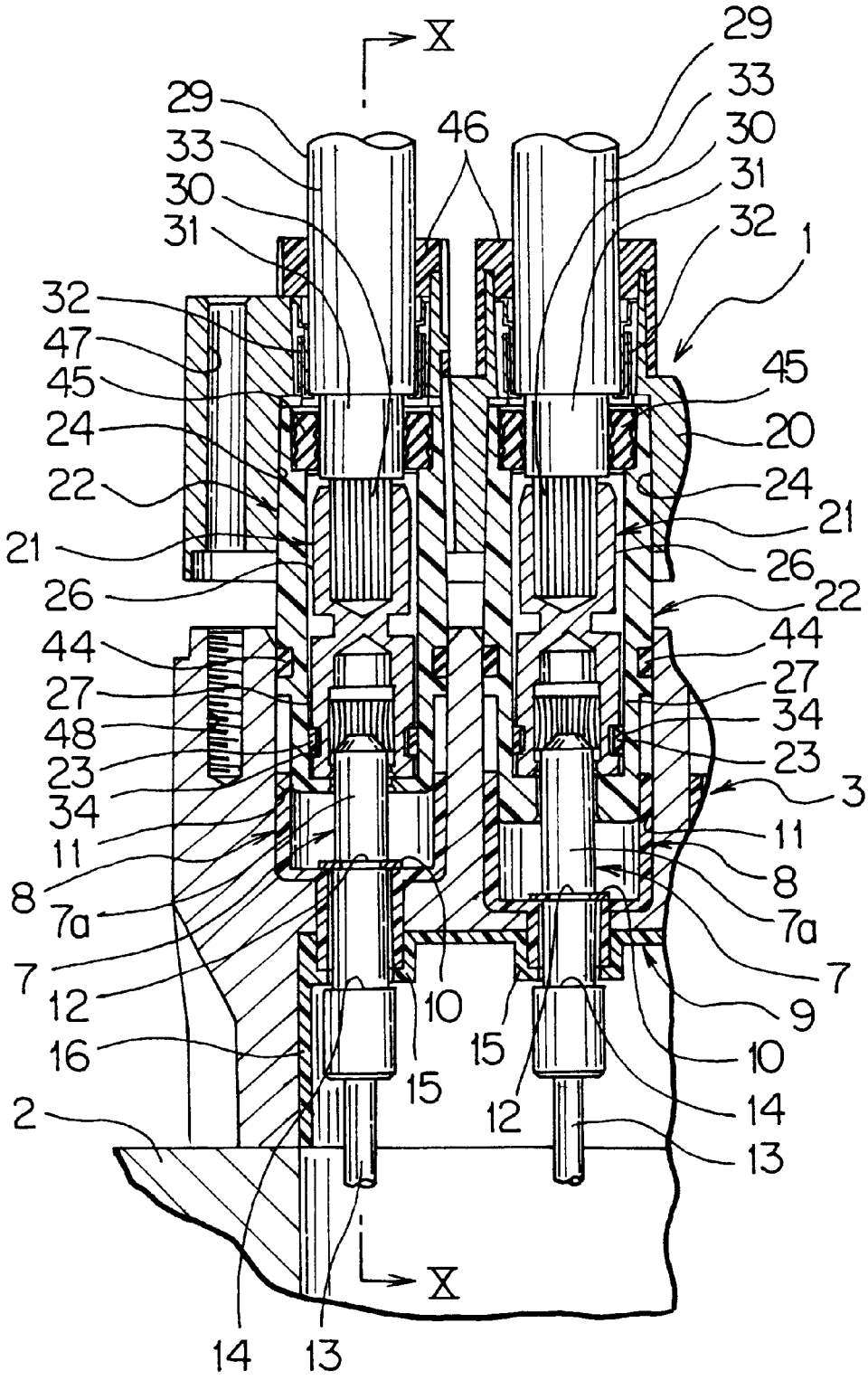
FIG. 9 is a partial sectional view of the connectors moved further closer to each other than those shown in FIG. 8.
Figure 12:
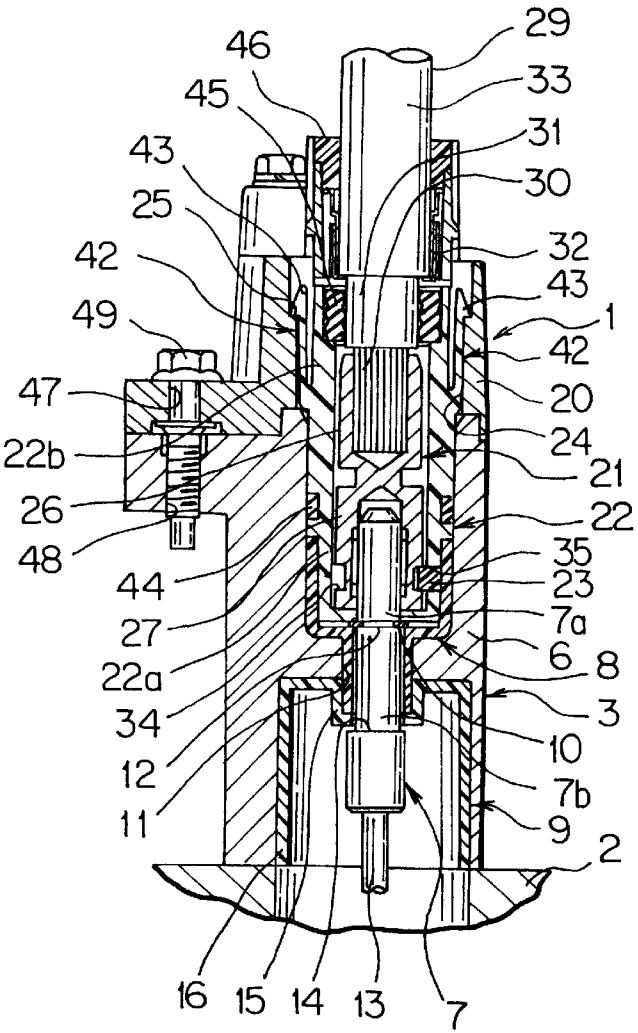
FIG. 12 is a sectional view taking along the line XII—XII in FIG. 11.
Figure 10:
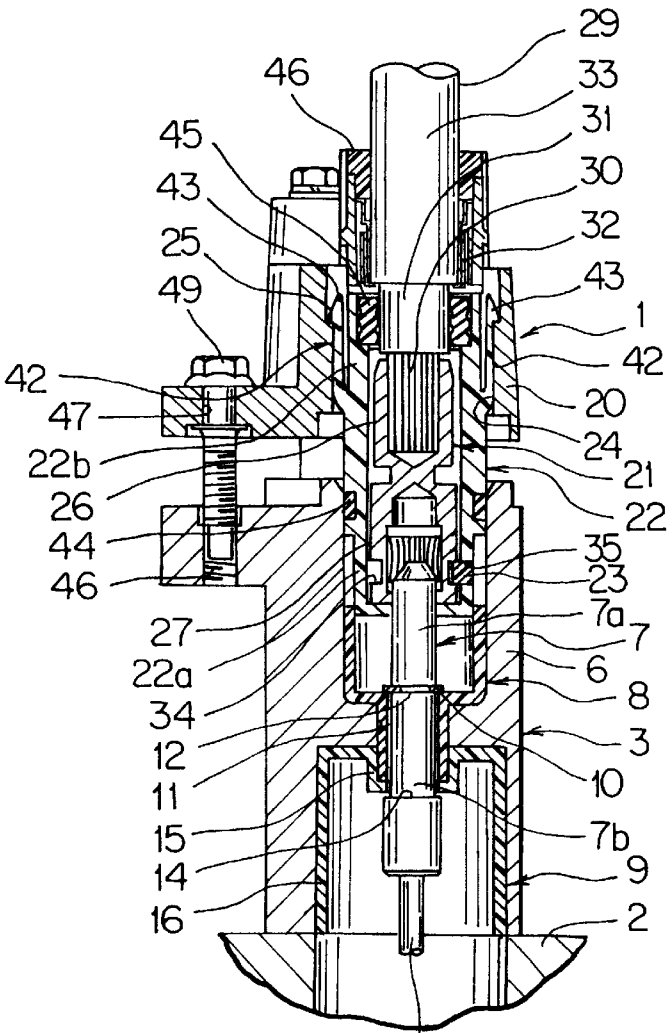
FIG. 10 is a sectional view taking along the line X—X in FIG. 9.
Figure 11:
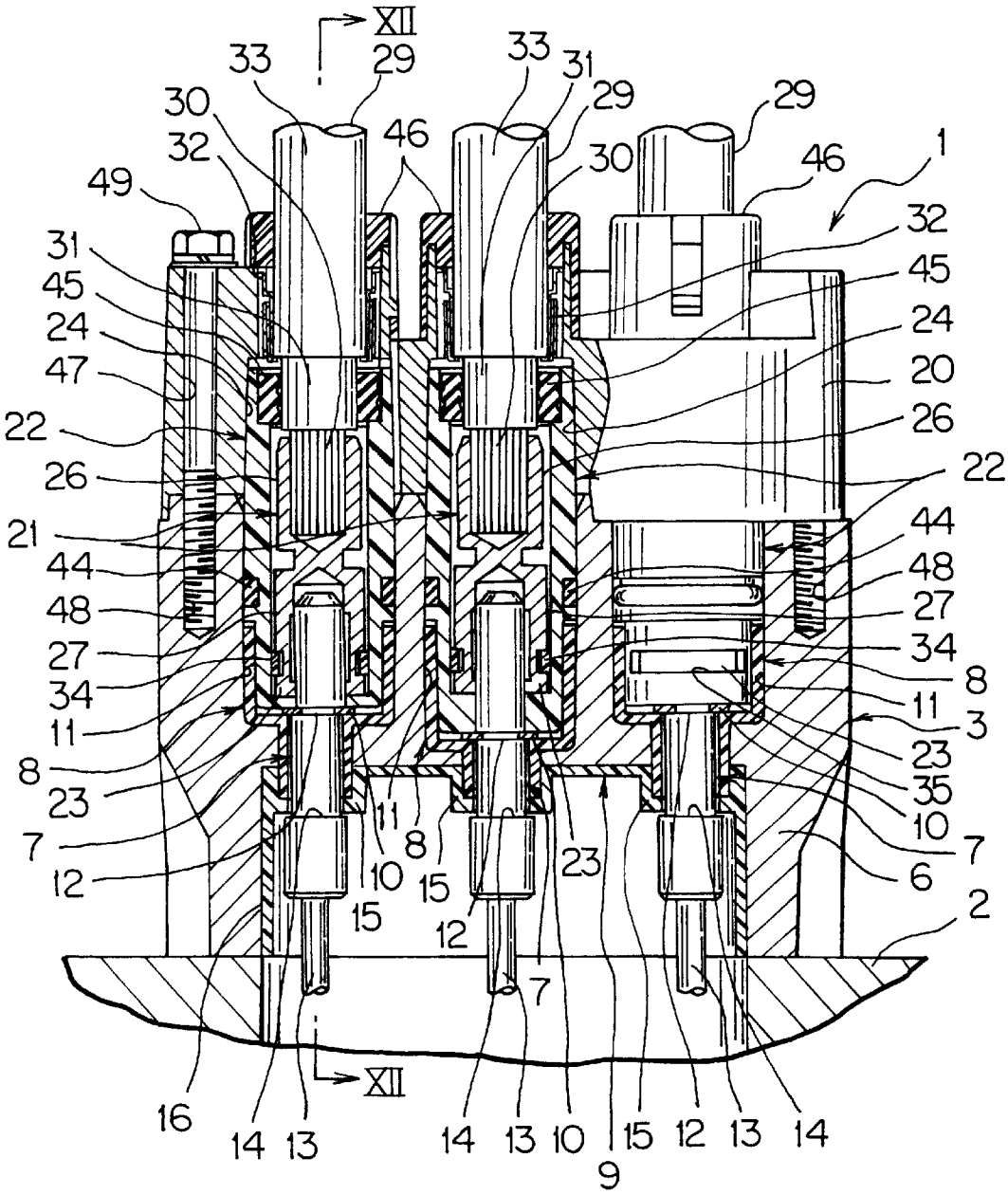
FIG. 11 is a partial sectional view of the connectors connected completely from those shown in FIG. 9.

As shown in FIGS. 9 and 10, the one end portions 7*a* of the terminals 7 of the mating connector 3 go into the respective electric contact portions 27 of the terminals 21 in the other two inner housings 22. The terminals 21 are fittingly moved and the terminals 21 are positioned against the one inner housing 22. Thereafter, the bolts 29 are screwed through the through holes 47 into the threaded holes 48.

Thereby, the inner housings 22 are inserted completely into the terminal receiving sections 11 of the mating connector 3 and the one end portions 7*a* of the terminals 7 of the mating connector 3 go into the respective electric contact portions 27 of the terminals 21. Thus, the terminals 7 and 21 are electrically connected to each other. The connector housings 6 and 20 are contacted to each other so that the connector housings 6, 20 and the braid 32 of the shield wire 29 are electrically connected together.

Electric power outputted from the AC/DC converter is supplied through the shield connector 1 to the motor 2.

According to this embodiment, the terminal 21 is mounted in the inner housing 22 by the spacer 23. By locking the elastic deformable lance 42 on the connector housing 20, the inner housing 22 is mounted in the connector housing 20. Thereby, the inner housing 22 can move freely against the connector housing 20 by elastically deforming the lance 42. Furthermore, the terminal 21 can move freely against the inner housing 22 by clearance between the terminal 21 and the inner housing 22.

Therefore, when the shield connector 1 is connected with the mating connector 3, the terminal 21 and the inner housing 22 move against the connector housing 20 so as to connect the terminal 21 with the terminal 7 of the mating connector 3. Thus, the shield connector 1 can be smoothly connected with the mating connector 3.

The lances 42 are formed integrally with the inner housing 22 of synthetic resin so that increasing number of parts can be prevented. Therefore, process steps for assembling can be prevented from increasing and product cost can be reduced.

When the shield connector 1 is connected with the mating connector 3, after the one inner housing 22 is firstly positioned against the connector housing 20, the other inner housings 22 are positioned against the connector housing 20. Therefore, the inner housings 22 are positioned securely against the connector housing 20 and the shield connector 1 can be securely connected with the mating connector 3.

The boundary 38 between the parallel surface 36 and the tapered surface 37 is located nearer to the opening along the arrow S than the center P. Thereby, when the spacer 23 is inserted into the inner housing 22, the pair of lock arms 39 is elastically deformed securely in a direction of moving the lock projections 41 close to each other. When the spacer 23 is extracted from the inner housing 22, the lock projections 41 are moved temporarily close to each other and, after the lock projections 41 pass the center P, the lock projections 41 are guided by the tapered surfaces 37 so that the lock arms 39 is elastically deformed in a direction of moving the lock projections 41 apart from each other. Therefore, the spacer 23 can be securely inserted into the inner housing 22 and securely extracted from the inner housing 22.

In the embodiment mentioned above, a three-phase alternating-current (AC) motor is used as the motor 2. According to the present invention, other type motor can be used. In the embodiment mentioned above, the motor 2 is connected with the AC/DC converter. According to the present invention, the motor 2 can be connected with other type electronic device other than the AC/DC converter. In the embodiment mentioned above, the shield connector 1 has three terminals 21. According to the present invention, the shield connector 1 can have any number of the terminals 21.

Although the present invention has been fully described by way of examples with reference to the accompanying drawings, it is to be noted that various change and modifications can be made with the scope of the present invention.

What is claimed is:

1. A shield connector, connecting to a mating connector, having a terminal joined with an electric wire, an inner housing made of an insulating synthetic resin for receiving said terminal and a connector housing made of a metal for receiving said inner housing, the inner housing electrically insulating said terminal from said connector housing, comprising:

a hole passing through the inner housing;

a spacer inserted into said hole and mounted in said inner housing to prevent said terminal from coming off from the inner housing; and a locking portion formed integrally, in an elastically deformable manner, with the inner housing, said locking portion being deformed elastically by insertion of the inner housing into the connector housing and returned to its original position by elastic restoring force after the inner housing being received in the connector housing for locking with the connector housing.

2. The shield connector according to claim 1, further comprising:

a plurality of said terminals; and a plurality of said inner housings, projecting from the connector housing and penetrating into the mating connector when the connector is connected with the mating connector, wherein a length of projection of one of the plurality of inner housings is longer than that of the others.

* * * * *